US006097918A

United States Patent [19]

Inoue et al.

[11] Patent Number: 6,097,918

[45] Date of Patent: Aug. 1, 2000

[54] IMAGE FORMING APPARATUS

[75] Inventors: Atsushi Inoue, Ikoma-gun; Toshihiko Takaya, Nara; Takayuki Yamanaka, Tenri; Hiroshi Tatsumi, Shiki-gun; Takashi Sakai, Kitakatsuragi-gun; Nobuhiko Nakano, Nara, all of Japan

[73] Assignee: Sharp Kabushiki Kaisha, Osaka, Japan

[21] Appl. No.: 09/313,259

[22] Filed: May 18, 1999

[30] Foreign Application Priority Data

May 28, 1998 [JP] Japan ..... 10-146794

[51] Int. Cl.[7] ..... G03G 15/08

[52] U.S. Cl. ..... 399/265

[58] Field of Search ..... 399/159, 162, 399/163, 167, 222, 225, 226, 265

[56] References Cited

U.S. PATENT DOCUMENTS

| | | | |
|---|---|---|---|
| 5,029,677 | 7/1991 | Mitsui . | |
| 5,140,868 | 8/1992 | Mizuno et al. . | |
| 5,420,664 | 5/1995 | Miwa et al. | 399/167 |
| 5,425,584 | 6/1995 | Ide . | |
| 5,489,086 | 2/1996 | Kanda . | |
| 5,745,472 | 4/1998 | Son . | |
| 5,749,269 | 5/1998 | Szymanski et al. . | |
| 5,758,419 | 6/1998 | Yanagida . | |
| 5,905,927 | 5/1999 | Inoue et al. | 399/167 |

FOREIGN PATENT DOCUMENTS

| | | |
|---|---|---|
| 695562 | 4/1994 | Japan . |
| 695563 | 4/1994 | Japan . |
| 6-264970 | 9/1994 | Japan . |
| 7-140841 | 6/1995 | Japan . |

*Primary Examiner*—Sandra Brase

[57] ABSTRACT

An image forming apparatus has a photoreceptor drum and a developing roller supported in the developing unit for retaining and conveying the developer, and further has a sealed viscous fluid damper having a viscous fluid sealed therein, arranged coaxially with the rotary shaft of the photoreceptor drum.

13 Claims, 7 Drawing Sheets

IMAGE FORMING APPARATUS

BACKGROUND OF THE INVENTION (1) Field of the Invention

The present invention relates to an image forming apparatus which includes a static latent image support and a developer support which is supported in a developing unit and retains and conveys a developer so as to produce a visual image by developing the static latent image formed on the peripheral surface of the static latent image support with the developer from the developer support.

(2) Description of the Prior Art

For electrophotographic development in a conventional, generally used image forming apparatus, dual-component development has been often used in which a non-magnetic developing sleeve incorporating a magnet roller supports a magnetic powder carrier together with toner as the developer, and supplies the toner for the development which involves a photoreceptor drum formed of α-Si, selenium, or an OPC etc.

Mono-component developing systems, which use no carrier, can be constructed of a simple and compact configuration, and are advantageous in terms of cost and maintenance. In particular, non-magnetic mono-component systems which use no magnetic toner, do not need a magnetic roller, and are advantageous in providing a developing unit which is simple in its mechanism and compact and inexpensive and still can produce clear images.

In dual-component development, the carrier which is made to stand like 'spikes' develops the static latent image previously formed on the photoreceptor drum by supplying the toner carried on the carrier surface to the static latent image. The toner carried on the carrier surface has been charged beforehand with a prescribed charge by being agitated in the toner hopper by means of paddles or agitator.

Magnetic mono-component development is categorized into two classes: the non-contacting development system whereby, similarly to dual-component development, magnetic toner is conveyed by a non-magnetic developing sleeve incorporating a magnetic roller while an alternating electric field is applied across the gap having a predetermined distance between the developing sleeve and photoreceptor drum so that the toner can travel in a reciprocating manner; and the contacting development system in which the toner is made to strongly stand like 'spikes' so as to bring itself in contact with the static latent image on the photoreceptor drum surface. The former needs a development bias of a d.c. voltage superimposed with an a.c. voltage and hence needs a complicated power system and a high withstand voltage configuration for the developing unit, whereas the latter may use a simple d.c. development bias power system but will produce Hi-gamma images, which are poor in gradation.

Non-magnetic mono-component development can be roughly categorized into two classes: the non-contacting development type whereby an alternating electric field is applied across the gap having a predetermined distance between the developing roller and photoreceptor drum so that the toner can travel in a reciprocating manner; and the contacting development type in which a conductive, elastic developing roller is put into contact with the photoreceptor drum. The former needs a development bias of a d.c. voltage superimposed with an a.c. voltage and hence needs a complicated power system and a high withstand voltage configuration for the developing unit, whereas the latter may use a simple d.c. development bias power source.

In any developing system, in the developing step (between the photoreceptor drum and the developing roller), if the frictions acting on the photoreceptor drum and/or the developing roller vary, jittering or banding (density unevenness and positional displacement of lines and strips along the direction perpendicular to the direction of movement of the photoreceptor drum) of 40 Hz to 100 Hz occurs as a result of backlash from the meshing of the gears and/or couplings. Such jittering or banding produces density unevenness in the image, and in the worst case, black strips and/or black and white banding unevenness perpendicular to the paper's conveyed direction may appear. In dual-component development, such a phenomenon is liable to occur due to variations in frictional resistance (load) between the carrier on the non-magnetic sleeve surface and photoreceptor drum. In mono-component developing systems, this tendency is more conspicuous in the contact type developing configuration where the elastic developing roller is in contact with the photoreceptor drum for development. In particular, in mono-component contact-development using an elastic developing roller, the developing roller is rotated at a circumferential speed different from that of the photoreceptor drum, therefore this frictional resistance may become very strong when all or almost all of the toner layer on the developing roller has been transferred to the photoreceptor drum, which may then cause image elongation.

In order to achieve an improved image quality by inhibiting the occurrence of jittering and banding, as a conventional method, Japanese Patent Application Laid-Open Hei 6 No.95,562 discloses a method in which jittering and banding are eliminated by providing an inertial body along the same axis, with an elastic damper. Japanese patent Application Laid-Open Hei 6 No.95,563 discloses another method in which a sealed oil body is abutted so as to increase the damping ratio. Japanese patent Application Laid-Open Hei 7 No.140,841 discloses a method in which a mass component is mounted via a damping component inside the photoreceptor drum so as to damp vibrations by increasing the moment of inertia.

For the above configurations, in a development system having a photoreceptor drum and a developing sleeve with magnetic brush, or a photoreceptor drum and a developing unit having a developing roller retaining toner on the surface thereof, the vibration unique to each unit vibrates the latent image and/or developed image on the photoreceptor drum thus causing jittering and/or banding in the image.

On the other hand, since the developing sleeve or developing roller produces frictional resistance against the photoreceptor drum in a manner which causes the photoreceptor drum to move in its direction of rotation, the rotation is always unstable due to the backlash of the gears and/or couplings, which results in the occurrence of jittering and/or banding in the image. In particular, since, in the magnetic brush configuration and in mono-component contact-development, the circumferential speed of the developing sleeve (developing roller) is higher than that of photoreceptor drum, the rotation of the photoreceptor drum is accelerated, which may cause image elongation.

With reference to an example of mono-component contact-development, the developing roller, for example, was configured of a homogeneous material with a uniform outside diameter across the full length including both the toner layer forming area and the toner layer non-forming area. Therefore, in contact-development in which the photoreceptor drum and the developing roller are put in pressure contact with each other with a differential relative speed, an excessive friction will arise between the photoreceptor drum and the developing roller at both ends where no toner is adhering on the developing roller, which increases and fluctuates the load torque acting on the photoreceptor drum and the developing roller. Further, this would make the rotation of the photoreceptor drum and the developing roller unstable, thus causing the problem of image unevenness with respect to the auxiliary direction (the conveyed direction of copy paper).

If the rotational irregularity is tried to be solved by making only the toner layer forming area on the developing roller come into contact with the photoreceptor drum, the degree of slipping between the developing roller and the photoreceptor drum varies depending upon the amount of development. Additionally, if an elastic developing roller is used, its outside diameter is liable to vary depending upon the change in environment, especially change in temperature, which varies the frictional resistance. So, even when high accuracy parts are used, it is impossible to perfectly eliminate the variations of the load torque.

Dual-component development also has the same defects as mono-component development since the dimensional variations of the constituent parts depending upon the environment occur in a similar manner.

In non-contacting development, variations in frictional resistance are overcome to some extent, but a vibration control device is not effective in dealing with all environments and change from aging (wear of parts) since each constituent part has a characteristic frequency different from the other.

To deal with such problems, the aforementioned method has been known in which an inertial component and dynamic damper are set in the photoreceptor drum so as to stabilize the rotation of the drum. However, this configuration needs a large inertial component in order to suppress micro variations in rotation. Alternatively, in order to stabilize the frictional resistance, a configuration using a brake has been proposed. However, both of these need a complicated mechanism for absorbing the variations in rotational speed resulting from the change of the frictional resistance and still are not very effective.

The inertial component disclosed in Japanese Patent Application Laid-Open Hei 6 Nos.95,562 and 95,563 and Hei 7 No. 140,841, is attached in the interior of the photoreceptor drum (the inertial component is integrally fixed with a dynamic damper in Japanese Patent Application Laid-Open Hei 6 No.95,562). Since the integral assembly of the photoreceptor drum and the inertial component has a considerably large mass and moment of inertia, an excessive load acts on the driving motor at activation so that the motor needs to have a large starting torque.

Naturally, there is another problem in that a long time is required until the photoreceptor drum ceases its rotation when operation stops.

SUMMARY OF THE INVENTION

The present invention has been devised in view of the above problems and it is therefore an object of the present invention to reliably prevent the occurrence of jittering and banding due to torque variations by providing a sealed viscous fluid damper having a viscous fluid therein, coaxially with the rotary shaft of either or both of the static latent image support and the developer support.

In order to achieve the above object, the present invention is configured as follows:

In accordance with a first embodiment of the invention, an image forming apparatus includes: a static latent image support; and a developer support which is supported in a developing unit and retains and conveys a developer so as to produce a visual image by developing the static latent image formed on the peripheral surface of the static latent image support with the developer from the developer support, and is constructed such that a sealed viscous fluid damper having a viscous fluid sealed therein is provided coaxially with the rotary shaft of either or both of the static latent image support and the developer support.

In accordance with a second embodiment of the invention, the image forming apparatus having the features of the first embodiment, is constructed such that the sealed viscous fluid damper comprises: an outer sleeve coaxially provided with the rotary shaft and being rotatable therewith; a rotary inertial body having a smaller outside diameter than the inside diameter of the outer sleeve and coaxially mounted inside the outer sleeve so as to be freely rotatable; and a viscous fluid sealed between the outer sleeve and the rotary inertial body.

In accordance with a third embodiment of the invention, the image forming apparatus having the features of the second embodiment, is constructed such that the viscous fluid is sealed between the peripheral surface of the outer sleeve and that of the rotary inertial body, and the outer sleeve is integrally fixed to the rotary shaft of either or both of the static latent image support and the developer support.

In accordance with a fourth embodiment of the invention, in the image forming apparatus having any one of the features of the first three embodiments, the viscous fluid is silica gel.

DESCRIPTION OF THE PREFERRED EMBODIMENTS

Figure 1:
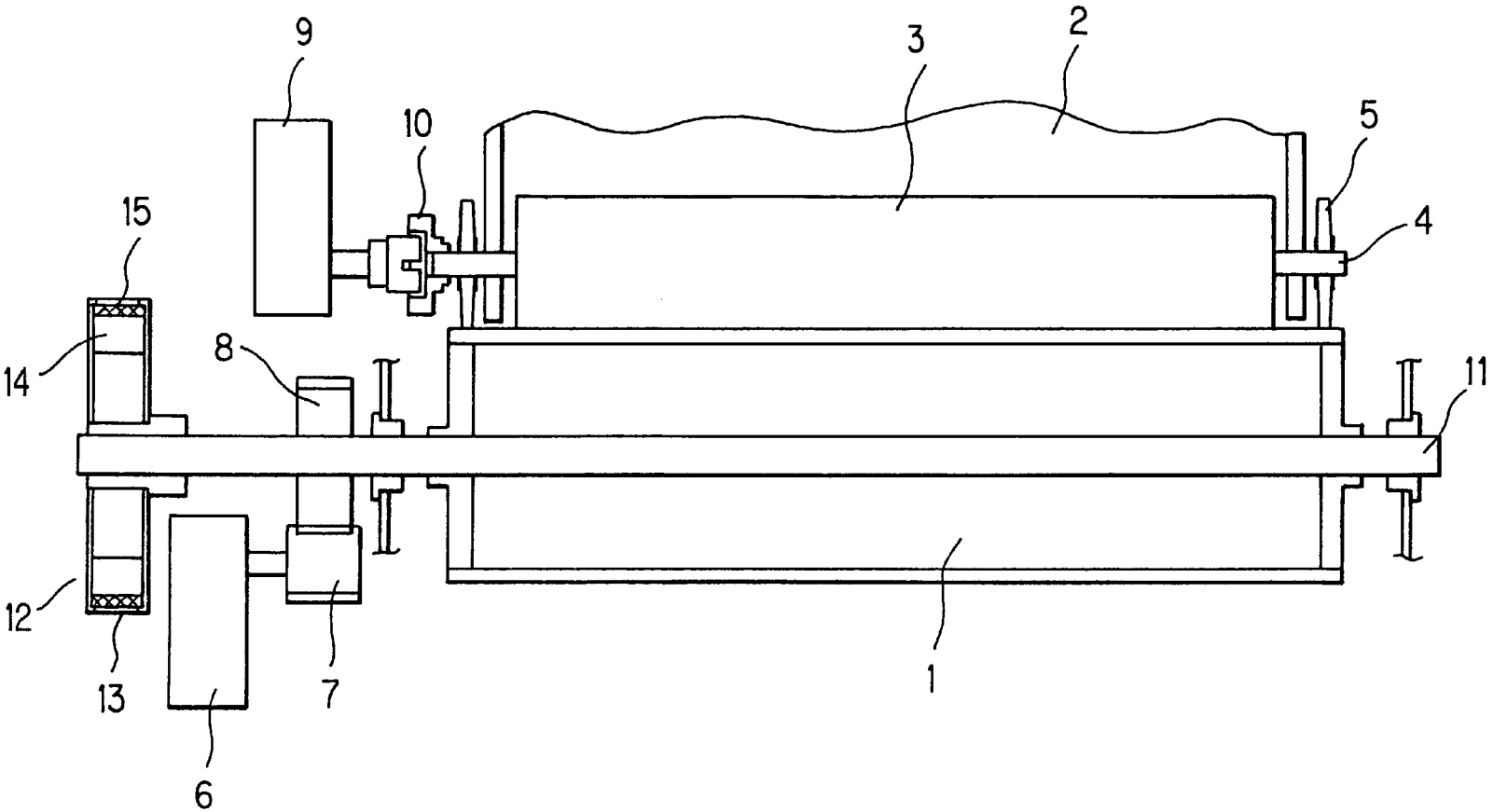
FIG. 1 is a transverse sectional view showing the first embodiment of an electrophotographic digital copier of the present invention.

The first embodiment of a mono-component contacting development type electrophotographic digital copier of as an image forming apparatus of the present invention will be described with reference to FIG. 1.

In the electrophotographic digital copier of the first embodiment, a mono-component contact-developing unit is arranged opposing a photoreceptor drum 1 as the static latent image support.

The contact depth between photoreceptor drum 1 and a developing roller 3 axially and rotatably supported in a casing 2 of this mono-component contact-developing unit is limited by a contact depth setting roller 5 with a contact depth δ of 0.1 mm. This roller 5 is formed of polyacetal resin, which will distort or deform so little that the influence of the deformation will be negligible and is hence excellent in rigidity, and is integrally formed with a rotary shaft 4 of developing roller 3.

Photoreceptor drum 1 is rotationally driven by a driving motor 6 via gears 7 and 8 while developing roller 3 is rotationally driven by a driving motor 9 via coupling 10.

Developing roller 3 rotates in the direction opposite to that of photoreceptor drum 1; that is, the surface of developing roller 3 at the opposing portion with photoreceptor drum 1 moves in the same direction as the surface of photoreceptor drum 1 moves. The circumferential speed of developing roller 3 is one and half times of the circumferential speed (the process speed) of photoreceptor drum 1.

Fixed coaxially to a rotary shaft 11 of photoreceptor drum 1 is a sealed viscous fluid damper 12.

Figure 2A:
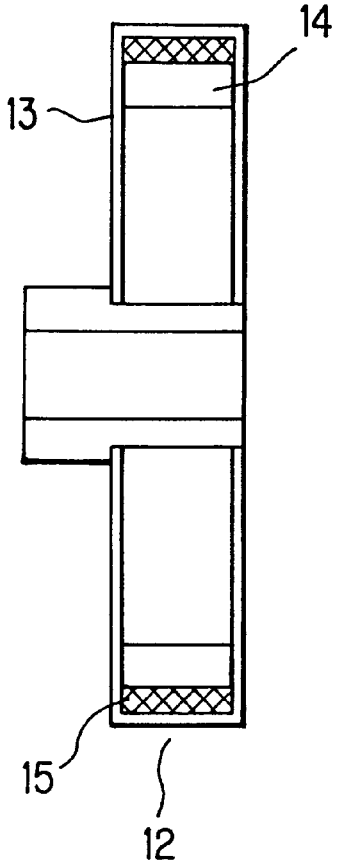
FIG. 2A is a vertical sectional view of a sealed viscous fluid damper shown in FIG. 1, viewed from the side.
Figure 2B:
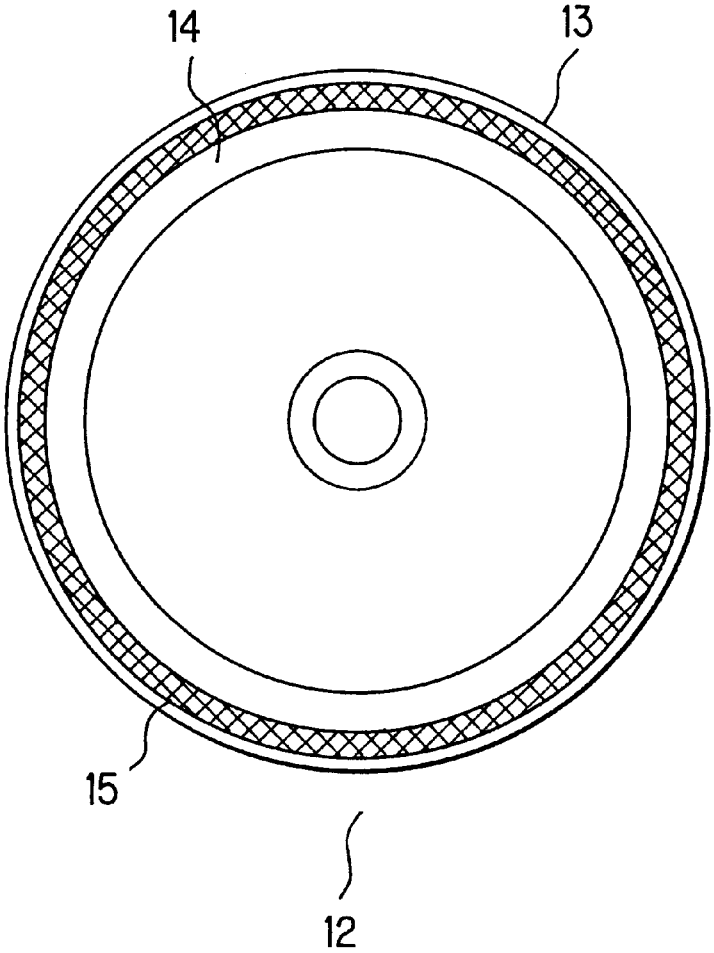
FIG. 2B is a vertical sectional view of a sealed viscous fluid damper shown in FIG. 1, viewed from the front.
Figure 3:
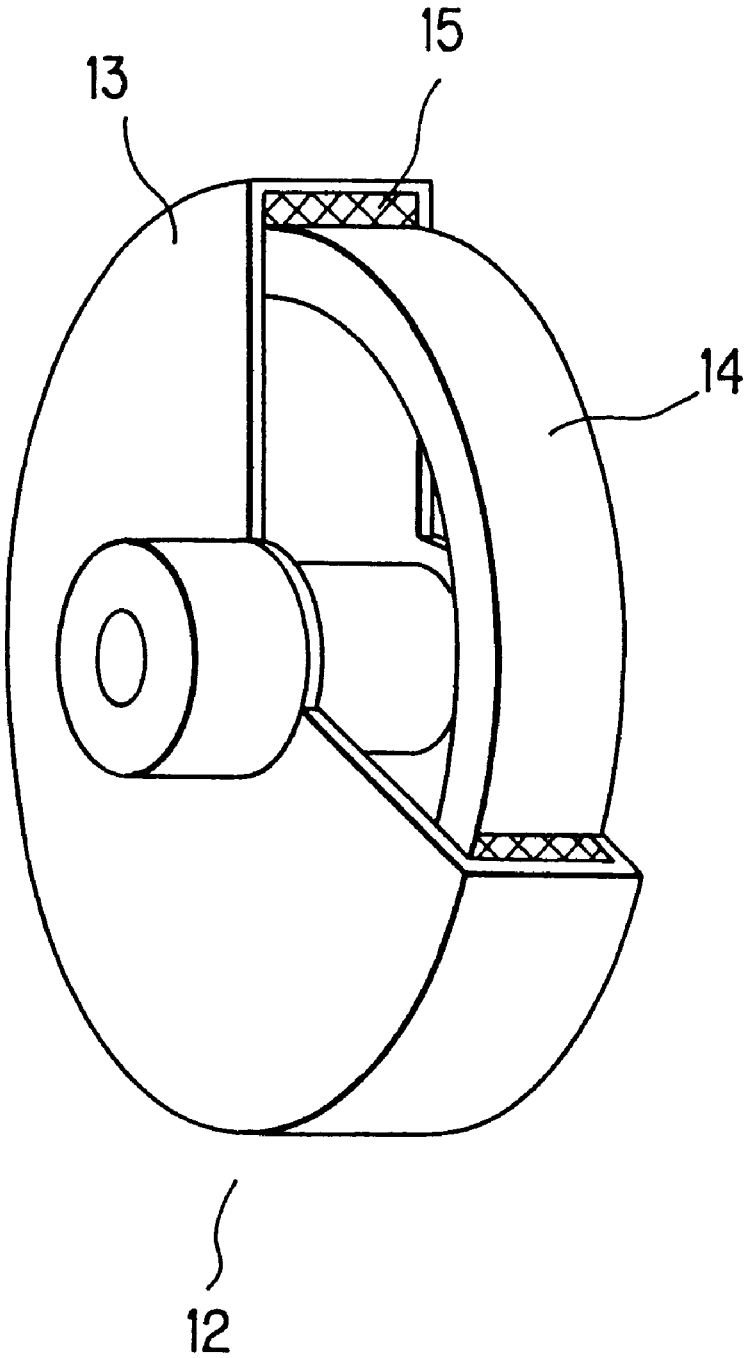
FIG. 3 is a partially cutaway view showing a sealed viscous fluid damper shown in FIG. 1.

This sealed viscous fluid damper 12 comprises: as shown in FIGS. 2A, 2B and 3, an outer casing 13 fixed on rotary shaft 11 of photoreceptor drum 1; an inertial body 14 coaxially mounted inside outer casing 13 and separated by a gap from the inner peripheral surface of outer casing 13; and silica gel 15 as a viscous fluid to fill the gap between the peripheral surfaces of outer casing 13 and inertial body 14.

Inertial body 14 in sealed viscous fluid damper 12 is mounted so that it can freely rotate inside outer casing 13. There is a gap formed between the inner peripheral surface of outer casing 13 and the outer peripheral surface of inertial body 14. Silica gel 15 fills this gap so that inertial body 14, freely rotatable within outer casing 13, can be dragged by the viscous resistance of silica gel 15, following the rotation of outer casing 13.

Therefore, when outer casing 13 is rotating at a uniform speed, inertial body 14 is also rotating uniformly at the same speed.

On the other hand, when outer casing 13 temporarily increases or decreases its rotational speed, inertial body 14 will continue to rotate at the fixed speed due to its inertia.

In this case, inertial body 14 pulls outer casing 13 by the viscous drag of silica gel 15 so as to keep outer casing 13 rotating at the fixed speed.

Thus, sealed viscous fluid damper 12 as a whole will not change its rotational speed suddenly.

Accordingly, when sealed viscous fluid damper 12 rotates following the rotation of photoreceptor drum 1, inertial body 14 enclosed therein is dragged via silica gel 15 by outer casing 13 and produces inertial force. Therefore, when photoreceptor drum 1 and sealed viscous fluid damper 12 rotate at a fixed speed, outer casing 13 and inertial body 14 rotate at the fixed rate.

On the other hand, due to influences of the offset in developing roller 3 and the offset in contact depth setting roller 5 and shape inaccuracy of photoreceptor drum 1, contact depth δ fluctuates, varying the frictional resistance between photoreceptor drum 1 and developing roller 3.

Consequently, a varying torque in the rotational direction acts on photoreceptor drum 1 so as to cause the rotational speed of photoreceptor drum 1 to change. However, from the aforementioned actions of the inertia of inertial body 14 and the viscous resistance from silica gel 15 as the viscous fluid, the varying torque of photoreceptor drum 1 is stabilized so that the rotational speed of the drum can be maintained.

As an example, an electrophotographic digital copier from Sharp Kabushiki Kaisha, namely, AR5130, or a AR5130 modified machine for experiment, was used for the experiment. When a flywheel of SECC steel sheet having a moment of inertia of 95 $kg \cdot cm^2$ was attached on rotary shaft 11 of photoreceptor drum 1, jittering, i.e., density unevenness in the image would have appeared in some cases with variations of the frictional resistance between photoreceptor drum 1 and developing roller 3. In contrast, when a sealed viscous fluid damper 12 having the same moment of inertia was mounted, neither jittering nor banding appeared even when the frictional resistance varied. Thus, when a flywheel enclosed with silica gel 15 was used, a greater effect could be obtained even with the same moment of inertia, thus making it possible to eliminate chattering of the cleaning blade, load variations of the charging and transfer rollers as a whole.

This effect did not depend on the process speed, and the same effect could be obtained within the range from 25 mm/s to 320 mm/s. Further, this result will not be limited to a particular developing system, but this configuration is especially effective in mono-component contacting development using an elastic developing roller in which the frictional resistance between the photoreceptor drum and the developing roller is the greatest.

Figure 4:
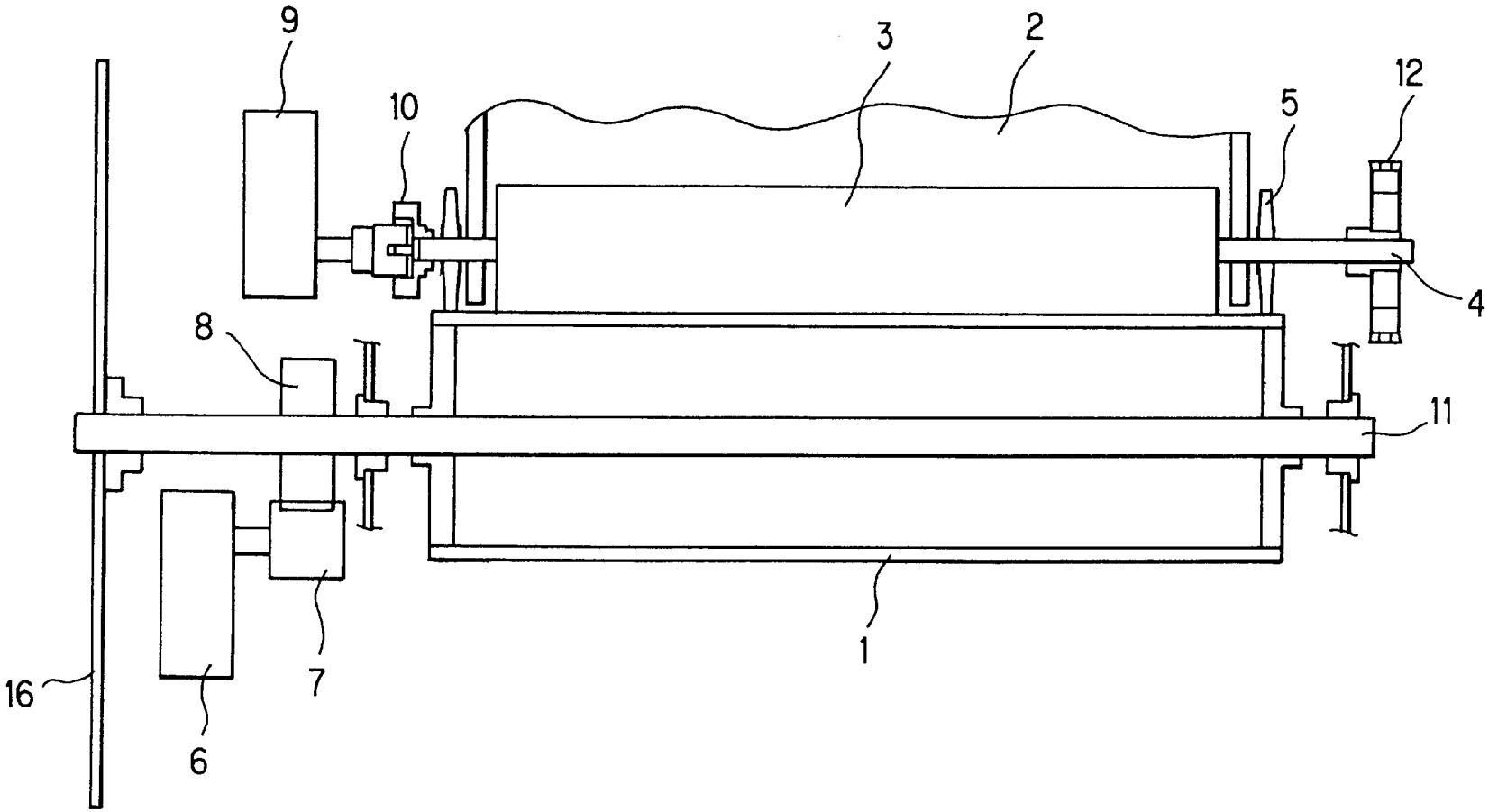
FIG. 4 is a transverse sectional view showing the second embodiment of an electrophotographic digital copier of the present invention.
Figure 5:
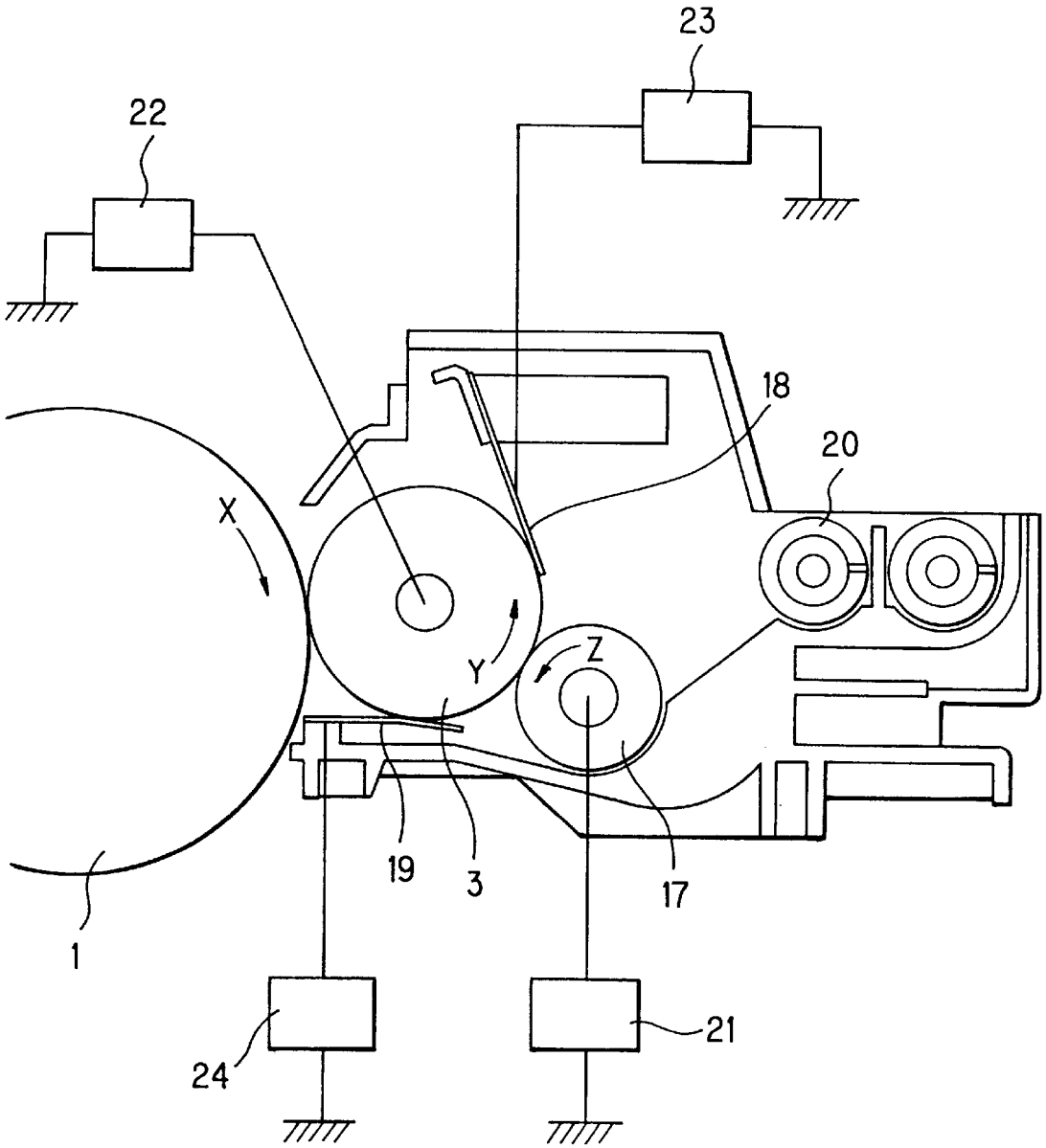
FIG. 5 is a vertical sectional view showing the second embodiment of an electrophotographic digital copier of the present invention.

Referring next to FIGS. 4 and 5, the second embodiment of a mono-component contacting development type electrophotographic digital copier of the invention will be described.

The basic configuration of the electrophotographic digital copier of the second embodiment is approximately the same as that of the first embodiment. The differences are that a flywheel 16 formed of SECC metal sheet is coaxially provided at the outer side of gear 8 on rotary shaft 11 of photoreceptor drum 1, and a sealed viscous fluid damper 12 is coaxially provided at one end of rotary shaft 4 of developing roller 3.

Placed in pressure contact with developing roller 3 is a toner supplying roller 17, which is rotated in the same direction as developing roller 3 rotates. That is, the surface of roller 17 moves in the direction opposite to that of developing roller 3 at its opposing position with developing roller 3.

The toner which has been in contact with, and triboelectrified by, toner supplying roller 17 and supplied to developing roller 3 under the action of the bias voltage, is conveyed by the rotation of developing roller 3 to a position where a toner layer limiting member 18 is abutted. This toner layer limiting member 18 is made up of a metal plate and has one side surface pressed against developing roller 3 at or near the distal end. By controlling the setting pressure and setting position of the limiting member, the toner on developing roller 3 is controlled so as to have the specified amount of static charge with a controlled thickness, and then is conveyed to the developing area where the developing roller faces photoreceptor drum 1, for implementation of the developing step.

Unused toner on developing roller 3 which has not been used during the developing step returns into the developing unit by the rotation of developing roller 3. Upon this toner collection, the unused toner on the developing roller 3 is removed of static charge by means of a charge erasing means 19 disposed between the developing area and toner supplying roller 17 and then is separated and collected into the toner tank (to be referred to as a hopper) by pressing abutment at the meeting nip with toner supplying roller 17 so that the toner can be reused.

A screw 20 conveys toner from the hopper (not shown) into the developing unit. This screw 20 and toner supplying roller 17 are supplied with driving force from developing roller 3 through an unillustrated series of gears.

Now, the operation of the thus configured mono-component contacting development type electrophotographic digital copier will be described. Toner stored in the hopper is conveyed into the developing unit by means of screw 20. Pressed against developing roller 3 is toner supplying roller 17, which is rotated in the same direction as the developing roller 3, so that the surface of toner supplying roller 17 moves in the direction opposite to that of developing roller 3 at its opposing position with developing roller 3. Toner supplying roller 17 is formed of a similar material to that of developing roller 3. Control of the electric resistance is also made using resistance control materials similar to those used for developing roller 3. In order to further enhance the elasticity, a foamed material is used for production of roller 17, with an increased amount of a foaming agent compared to that for developing roller 3.

Applied to toner supplying roller 17 is a bias voltage from a bias voltage source 21. This bias voltage is set so as to electrically urge the toner toward developing roller 3; for example, if the toner is of negative polarity, the bias voltage is set negative. The toner which has been put in contact with, and tribo-electrified by, toner supplying roller 17 and supplied onto developing roller 3 by the function of the bias voltage is conveyed by the rotation of developing roller 3 to a position where toner layer limiting member 18 is abutted. This toner layer limiting member 18 has one side surface pressed against developing roller 3 at or near the distal end, and by controlling its setting pressure and setting position, the toner on developing roller 3 is controlled so as to have the specified amount of static charge with a controlled thickness, and then is conveyed to the developing area for implementation of the developing step.

Unused toner on developing roller 3 which has not been used during the developing step returns into the developing unit by the rotation of developing roller 3. Upon this toner collection, the unused toner on the developing roller 3 is removed of static charge by means of charge erasing means 19 disposed between the developing area and toner supplying roller 17 and then is separated and collected into the hopper by pressing abutment of toner supplying roller 17 so that the toner can be reused.

The surface of photoreceptor drum 1 is charged to the predetermined potential by means of an unillustrated corona charger, a contact roller charging device or the like and formed with a latent image potential distribution by a separate exposure unit.

Photoreceptor drum 1 is composed of a metal or conductive base with thin film layers including: an under-layer applied thereon; a carrier generation layer (CGL) over the under-layer; and carrier transport layer (CTL) mainly consisting of polycarbonate as the outermost layer. The surface potential (charge) on charged photoreceptor drum 1 is canceled by carriers which will be generated in the CGL by light exposure from the lamp in an analog machine or by the light exposure from a laser, typically, in a digital machine, so as to form the aforementioned latent image potential distribution.

The static latent image formed on photoreceptor drum 1 is rotated and conveyed to the area opposing developing roller 3. In the developing area, photoreceptor drum 1 is abutted against developing roller 3 so that the toner which has been controlled beforehand in the predetermined manner as to static charge and layer thickness transfers to photoreceptor drum 1 in conformity with the latent image pattern to form a developed image.

After development of the latent image potential on photoreceptor drum 1 with the toner, photoreceptor drum 1 is rotated or moved to reach the transfer area of the transfer device. A recording sheet of paper fed by a separate paper feeder is conveyed into the transfer area in a synchronized manner and put into contact with the toner image on photoreceptor drum 1. The transfer device may be of a charger type having a high voltage power source or may be of a contact roller type. By either means, a voltage having the polarity which causes the toner on photoreceptor drum 1 to transfer to the recording sheet of paper is applied, thus the toner image on photoreceptor drum 1 moves and transfers to the recording sheet of paper.

After the completion of the transfer of the toner image, the recording sheet is usually conveyed into a heat fixing unit where the toner image on the recording sheet is fused and fixed thereon and the sheet is then discharged.

The untransferred toner remaining on photoreceptor drum 1 after the passage of the transfer area is removed from photoreceptor drum 1 by means of a cleaner. Then the residual charge on the photoreceptor surface is eliminated by a light erasure lamp, a contact type charge erasing means or the like so as to refresh the surface potential, and then followed again by the initial step.

Specific conditions of the second embodiment are that, photoreceptor drum 1 is a negative charge type drum having its conductive base grounded with a surface potential of −550 V, and a diameter Dp of 65 mm, and rotates at a circumferential speed Vp of 190 mm/s in the direction of arrow X in FIG. 5.

Developing roller 3 is a conductive, elastic developing roller made up of a conductive urethane rubber with an electrically conductive medium forming agent such as carbon black or the like added therein, having a volume resistivity of about $10^{16}$ Ωcm, a JIS-A hardness of 60 to 70 degrees and a diameter Dd of 34 mm, and rotates at a circumferential speed Vd of 285 mm/s in the direction of arrow Y in FIG. 5. Further, this roller is applied with a voltage $E_1$ of −250 V from development bias source 22 by way of a conductive supporting shaft (made up of stainless steel, conductive resin, or the like) having a diameter D1 of 18 mm. This developing roller is put in pressure contact with photoreceptor drum 1 with the toner layer therebetween at a contacting depth of 0.1 to 0.5 mm.

Toner supplying roller 17, which performs both functions of toner agitation and toner removal after development, is composed of a conductive urethane foam having a volume resistivity of about $10^5$ Ωcm, a cell density of 3 cells/mm and a diameter Dt of 20 mm, is put in contact with developing roller 3 with a contact depth of 0.5 to 1 mm, and rotates at a circumferential speed Vt of 170 mm/s in the direction of arrow Z in FIG. 5. This roller is applied with a bias voltage $E_2$ of −350 V from bias voltage source 21 by way of a conductive supporting shaft (made up of stainless steel, conductive resin, or the like) having a diameter $D_2$ of 8 mm.

The non-magnetic mono-component toner, which has been negatively pre-charged by toner supplying roller 17 and applied on the surface of developing roller 3, is conveyed by the rotation of developing roller 3 to the position where toner layer limiting member 18 is abutted. Toner layer limiting member 18 is a conductive plate-like member (made up of stainless steel, phosphor bronze, conductive resin, or the like) of 0.1 to 0.2 mm thick, and has a cantilever leaf spring structure having a free end on the upstream side with resect to the rotational direction of developing roller 3, so as to abut developing roller 3 with a line pressure of 15 to 30 gf/cm while being applied with a bias voltage $E_3$ of −350 V from a toner layer limiting member bias voltage source 33.

The toner layer on developing roller 3 is limited by toner layer limiting member 18 so as to have a mass of adherence of about 0.6 to 0.8 mg/cm$^2$with a toner charge amount of about −10 to −15 pC/g, and then is conveyed by the rotation of developing roller 3 to the developing area where the toner layer is opposed in contact with photoreceptor drum 1, to thereby perform contact reversal development.

Toner charge erasing means 19 also performs a sealing function for preventing the toner from leaking from the underside of developing roller 3, and is composed of a conductive film of 0.3 mm±0.1 mm thick having an electrical resistance of $10^3$ to $10^6$ Ω, and is set at the same potential as that of developing roller 3 or biased at abut −50 V or more relative to developing roller 3, by means of a bias voltage source 24 for toner charge erasing means. The conductive surface of the toner charge erasing means is abutted against developing roller 3.

When Ld is set equal to or greater than Lf in order to permit toner charge erasing means 19 to come in contact with the residual toner layer on developing roller 3 adequately up to both ends (where Lf represents the effective width, with respect to the axial direction, of the mono-component toner layer formed on the developing roller 3 and Ld represents the effective width of toner charge erasing means 19 located after the developing step), the charge on the remaining toner is made uniform so that it is possible to prevent toner removal failure as well as to prevent uneven supply.

Toner charge erasing means 19 can also be of aluminum metalized film or other conductive parts. Alternatively, when it is not necessary to remove toner charge, but only to seal the underside of developing roller 3, a polyester film such as Mylar™ film etc., may be used. In this case, no bias voltage source 24 for toner charge erasing means is needed.

Developing roller 3 uses an elastic member having a dielectric constant of about 10, and is made up of a metallic or low-resistance resin core (shaft) provided with single layer of a conducive rubber on the outer periphery. Preferred examples of the conductive rubber include: those based on a dispersion type resistance controlled resin in which one or more electric resistance control agents, selected from conductive micro-particles, carbon, $TiO_2$, are mixed and dispersed in a resin selected from resins such as EPDM, urethane, silicone, nitrile-butadiene rubber, chloroprene rubber, styrene-butadiene rubber, butadiene, etc; and those based on an electric resistance controlled resin which is prepared using one or more of ionic conductive materials, forexample, inorganicionicconductivematerials such as sodium perchlorate, calcium perchlorate, sodium chloride. When a foaming agent is used for the foaming and mixing step, a silicone surface active agent (poly-di-alky-siloxane, poly-siloxane polyalkylene-oxide block copolymer) is preferable.

Here, effective roller resistance 'r' of developing roller 3 with development current 'i' flowing upon development produces voltage drop Ed=i·r across developing roller 3. By adjusting this effective roller resistance r appropriately, the effective development bias acting on the surface of developing roller 3 can be lowered so as to adjust the development characteristics beneficially to improve the tonal reproduction by modifying the developing characteristics from binary, high contrast gradation to the gentile gradation.

Toner supplying roller 17 is one which is formed by the steps of mixing carbon black (ISAF, HAF, GPF, SRF, etc.) with polyurethane, stirring the mixture by a foaming mixer and heat blowing the foamed mixture to form a porous molding around a metal core shaft. As the polyurethane to be used, soft polyurethane foam and polyurethane elastomer are preferable. Developing roller 3 and toner supplying roller 17 are both injection molded and hot formed, then they are finished by abrading using a grinding stone into the desired outside dimensional shapes with desired surface features.

The toner used is one that is generally called 'high-resistance toner' and is produced by mixing and kneading carbon black with polyester resin or styrene-acrylic copolymer as the base resin, blending with a charge control agent (CCA) and a vulcanizing agent in appropriate amounts, crushing it and adding silica and other external additives to the power.

In the above configuration, there are some instances where the rotational speed of developing roller 3 fluctuates due to variations of the frictional resistance between developing roller 3 and toner supplying roller 17 or that between developing roller 3 and toner layer limiting member 18, causing unstable toner layer formation.

Further, even if the rotation is stable initially, the gears and couplings may become worn out over time, resulting in increase of the backlash. In such cases, image unevenness resulting from fluctuations of the rotational speed of developing roller 3 may occur.

In order to obtain a good stabilized circumferential speed, sealed viscous fluid damper 12 is provided on driving shaft 4 of developing roller 3. This makes it possible to inhibit the rotational speed fluctuations and vibrations of developing roller 3. This configuration could successfully produce a good image free from image unevenness with respect to the auxiliary scan direction (the conveyed direction of the copy sheet).

For example, when a sealed viscous fluid damper 12, having a moment of inertia of 516 g·cm$^2$, including an inertial body 14 and silica gel 15 was fixed on rotary shaft 4 of developing roller 3, it was possible to eliminate density unevenness due to Littering of 100 Hz to 120 Hz from the image. This effect did not depend on the process speed, so that the same result could be obtained within the range of 25 mm/s to 320 mm/s. When a sealed viscous fluid damper 12 was also attached coaxially with photoreceptor drum 1 in the same manner as the first embodiment, a further enhanced effect could be obtained to eliminate jittering and banding from the image.

Figure 6:
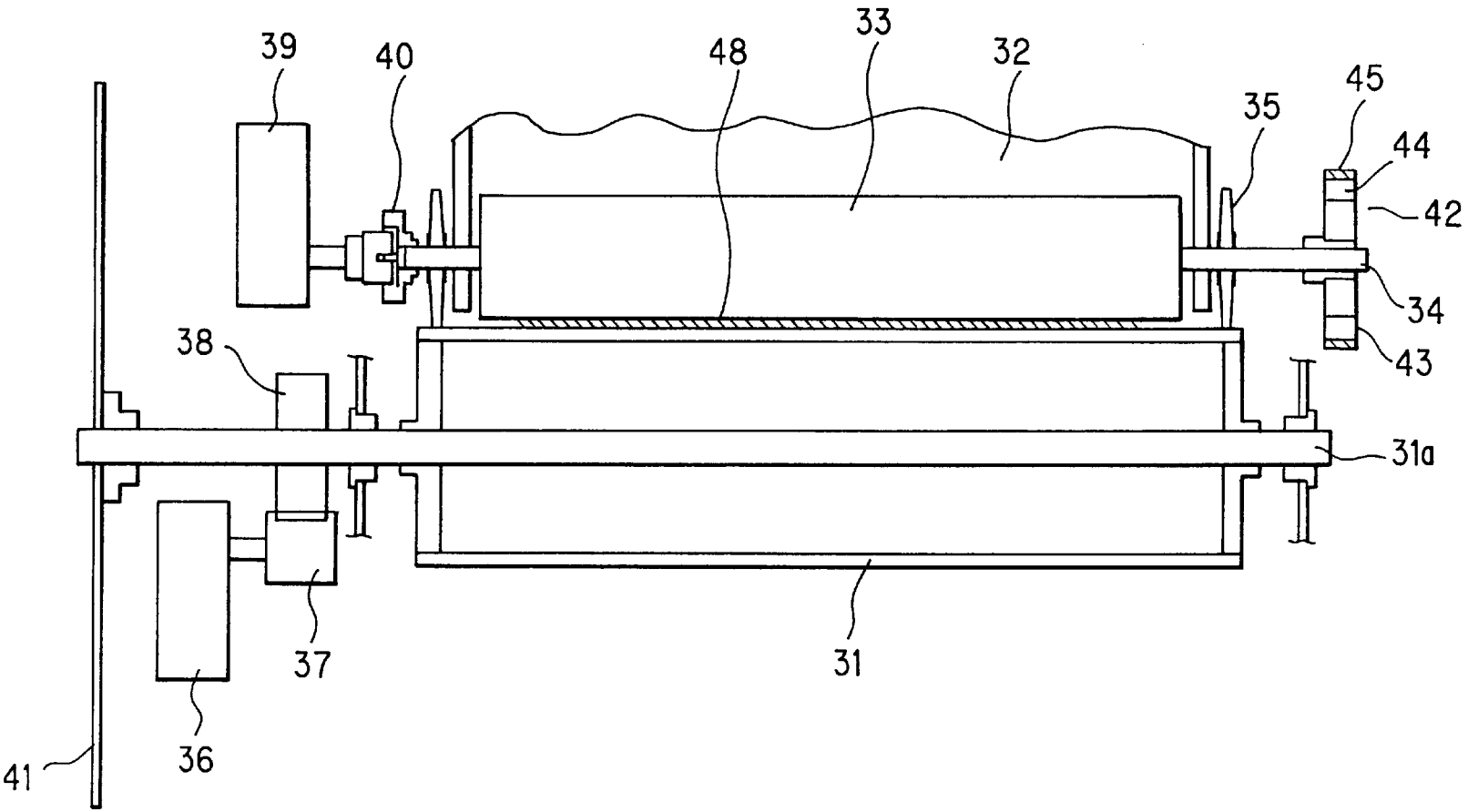
FIG. 6 is a transverse sectional view showing the third embodiment of an electrophotographic digital copier of the present invention.

Next, referring to FIGS. 6 and 7, the third embodiment of a dual-component development type electrophotographic digital copier of the present invention will be described.

In the electrophotographic digital copier of the third embodiment, a dual-component developing unit is arranged opposing a photoreceptor drum 31 as the static latent image support.

The development gap between photoreceptor drum 31 and a developing sleeve 33 which is axially and rotatably supported in a casing 32 of this dual-component developing unit is limited by a development gap setting roller 35 with a developing gap ϵ of 0.8 mm. This roller 35 is formed of polyacetal resin, which will distort or deform so little that the influence of the deformation will be negligible and is hence excellent in rigidity, and is integrally formed with a rotary shaft 34 of developing roller 33.

Photoreceptor drum 31 is rotationally driven by a driving motor 36 via gears 37 and 38 while developing sleeve 33 is rotationally driven by a driving motor 39 via a coupling 40.

Developing sleeve 33 rotates in the direction opposite to that of photoreceptor drum 31; that is, the surface of developing sleeve 33 at the opposing portion with photoreceptor drum 31 moves in the same direction as the surface of photoreceptor drum 31 moves. The circumferential speed of developing sleeve 33 is two times of the circumferential speed (the process speed) of photoreceptor drum 31.

Provided coaxially at the end of a rotary shaft 31*a* of photoreceptor drum 31, where gear 38 is attached, is a flywheel 41 of SECC steel sheet.

A sealed viscous fluid damper 42 is coaxially attached at one end of rotary shaft 34 of developing sleeve 33. This sealed viscous fluid damper 42 comprises an outer casing 43, an inertial body 44, and silica gel 45, as that shown in the first and second embodiments.

The dual-component developing unit has a developer supplying roller 46, which agitates the developer to thereby electrify the toner and supply it to developing sleeve 33. In order to form a thin layer of the developer by scraping excessive part of the developer adhering on the surface of developing sleeve 33 and in order to tribo-electrify the developer adhering on developing sleeve 33, a developer layer limiting member 47 is provided. This developer layer limiting member 47 and casing 32 constitute the developer storage.

The developer supplied to developing sleeve 33 is tribo-electrified by developer layer limiting member 47 and conveyed in the form of a magnetic brush 48, to the developing area where the developer opposes photoreceptor drum 31, for implementation of the developing step.

A screw 49 conveys toner from the hopper (not shown) into the developing unit. This screw 49 and developer supplying roller 46 are supplied with driving force from developing sleeve 33 through an unillustrated series of gears.

Now, the operation of the thus configured dual-component contacting development type electrophotographic digital copier will be described. In order to develop the static latent image formed on the surface of photoreceptor drum 31, the developer stored in the developer storage formed by casing 32 and developer layer limiting member 47, passes through the space where developing sleeve 33 and developer layer limiting member 47 are in close with each other, that is, the wedge-like space, in section, formed by developing sleeve 33 and developer layer limiting member 47, and is conveyed in the form of magnetic brush 48 having an appropriate thickness, to the area where photoreceptor drum 31 opposes developing sleeve 33.

Developer layer limiting member 47 is applied with a bias voltage from an unillustrated doctor bias source. Further, since the voltage can be controlled by an unillustrated applied voltage control means, the bias voltage is controlled so as to control the electric field between developer layer limiting member 47 and developing sleeve 33.

Figure 7:
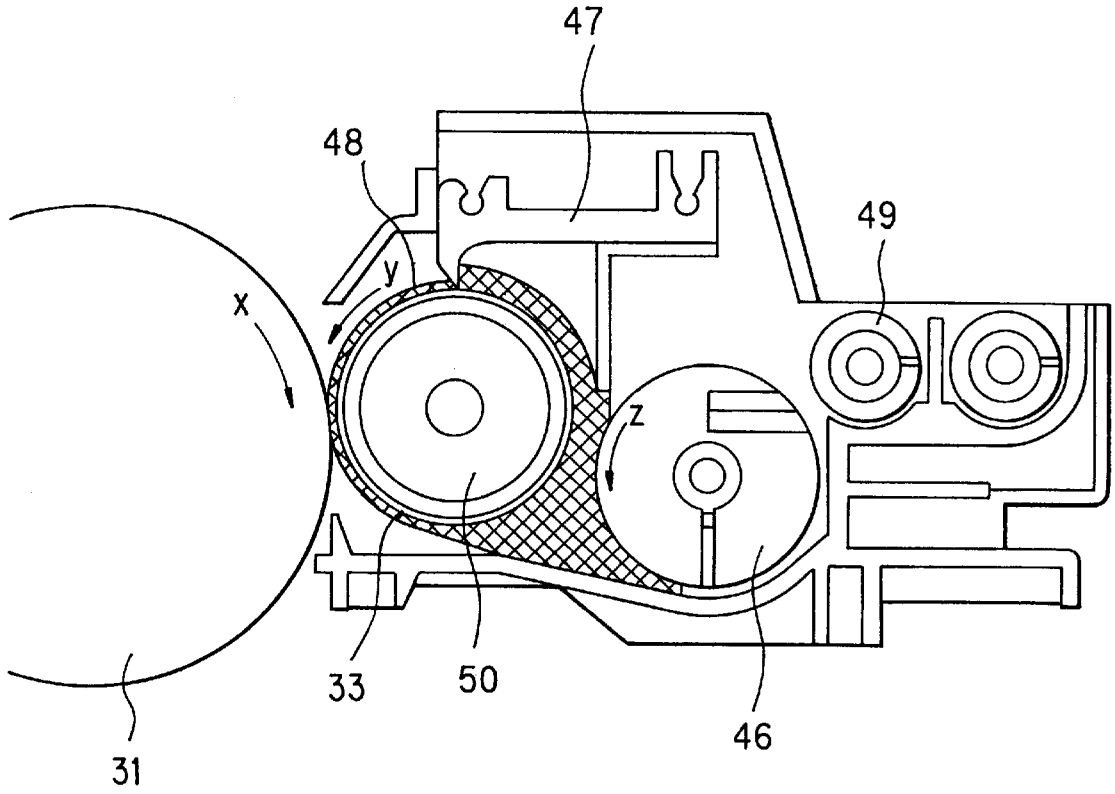
FIG. 7 is a vertical sectional view showing the third embodiment of an electrophotographic digital copier of the present invention.

Not only the developer electrically and magnetically adhering to the surface of developer sleeve 33, but also the developer located in the vicinity of developing sleeve 33 is dragged and conveyed by the rotation of developing sleeve 33 in the direction of arrow y in FIG. 7. Here, the space defined by developing sleeve 33 and developer layer limiting member 47 is wedge-like shaped, the developer is pressed against developing sleeve 33 with an increasing pressure, as the developer is conveyed toward developer layer limiting member 47, so that the developer bears an adequate amount of static charge.

Further, the amount of the developer adhering on the surface of developing sleeve 33 can be controlled to some degree by controlling the electric field between developing sleeve 33 and developer layer limiting member 47 by means of the bias source for developer layer limiting member 47. From the developer adhering on the surface of developing sleeve 33, any excessive amount is scraped by developer layer limiting member 47 so as to from a uniform developer layer on the surface of developing sleeve 33. This uniform developer layer is conveyed by the rotation of developing sleeve 33 to the developing area defined by developing sleeve 33 and photoreceptor drum 31, so as to develop the static latent image formed on the photoreceptor drum 31 by the electrophotographic process.

Thus, in this developing unit, the developer is pressed onto the developing sleeve 33 by the electric field generated between developer layer limiting member 47 and developing sleeve 33, and the developer in the gap between developer layer limiting member 47 and developing sleeve 33 is tribo-electrified adequately under the influence of the magnetic field of a magnet roller 50 inside developing sleeve 33, so that the developer will be stably retained on the surface of developing sleeve 33.

The mechanisms of charging of photoreceptor drum 31, formation of the static latent image, cleaning of leftover toner after transfer, transfer onto the recording sheet, fixing, etc., are the same as those of the aforementioned mono-component developing configuration, so the detailed description is omitted.

In the case of the above configuration, even if the rotation is stable initially, the gears and couplings may become worn out over time, resulting in increasing of the backlash. In such cases, image unevenness resulting from fluctuations of the rotational speed of developing sleeve 33, that is, due to rotational speed fluctuations of magnetic brush 48 formed on developing sleeve 33, may occur.

For this reason, in order to obtain a good stabilized circumferential speed, sealed viscous fluid damper 42 is provided on driving shaft 34 of developing sleeve 33. This makes it possible to inhibit the rotational speed fluctuations and vibrations of developing sleeve 33. This configuration could successfully produce a good image free from image unevenness with respect to the auxiliary scan direction (the conveyed direction of the copy sheet).

For example, when the driving torque acting on developing sleeve is 3.0 kg·cm, the frictional resistance with the photoreceptor is about 5 kg·cm though it depends on the clearance between photoreceptor drum 31 and developing sleeve 33 and the magnetic flux of magnet roller 40 in developing sleeve 33. In this case, when a sealed viscous fluid damper 42, having a moment of inertia of 516 $g \cdot cm^2{}_1$, including an inertial body 44 and silica gel 45 was attached, it was possible to eliminate density unevenness due to jittering of 100 Hz to 120 Hz from the image.

This effect did not depend on the process speed, so that the same result could be obtained within the range of 25 mm/s to 320 mm/s. Further, when a sealed viscous fluid damper 42 was also attached coaxially with photoreceptor drum 31 in the same manner as the first embodiment, a further enhanced effect could be obtained to eliminate jittering and banding from the image.

In accordance with the first feature of the invention, the image forming apparatus includes: a static latent image support; and a developer support which is supported in a developing unit and retains and conveys a developer so as to produce a visual image by developing the static latent image formed on the peripheral surface of the static latent image support with the developer from the developer support, and is configured so that a sealed viscous fluid damper having a viscous fluid sealed therein is provided coaxially with the rotary shaft of either or both of the static latent image support and the developer support. Therefore, it is possible to reliably produce a high quality image by preventing the occurrence of jittering and banding due to toque variations of the static latent image support and the developer support. Further, since a lightweight, sealed viscous fluid damper is used to prevent jittering and other defects, it is possible to use compact driving motors for the static latent image support and the developer support.

In accordance with the second feature of the invention, the sealed viscous fluid damper comprises: an outer sleeve coaxially provided with the rotary shaft and being rotatable therewith; a rotary inertial body having a smaller outside diameter than the inside diameter of the outer sleeve and coaxially mounted inside the outer sleeve so as to be freely rotatable; and a viscous fluid sealed between the outer sleeve and the rotary inertial body. Therefore, it is possible to suppress the variations in the rotational speed of the rotational components (static latent image support and/or developer support) using a light-weight inertial body. Further, since the sealed viscous fluid damper can also be made lightweight as a whole, it is possible to reduce the time required for stopping the rotational components.

In accordance with the third feature of the invention, since the outer sleeve is integrally fixed to the rotary shaft of either or both of the static latent image support and the developer support, the rotational speed fluctuations due to the backlash between the sealed viscous fluid damper and the rotational component can be prevented more effectively compared to a configuration using gears and couplings.

In accordance with the invention with the fourth feature of the invention, since silica gel is used for the viscous fluid, it is possible to obtain a further improved effect even with the same moment of inertia.

In the present invention, as the viscous fluid, silica gel is exemplified. Nevertheless, any other viscous fluids may be equally used as far as they exhibit similar characteristics as silica gel.

What is claimed is:

1. An image forming apparatus comprising:

a static latent image support:

a developer support which is supported in a developing unit and retains and conveys a developer so as to produce a visual image by developing the static latent image formed on the peripheral surface of the static latent image support with the developer from the developer support, a sealed viscous fluid damper having a viscous fluid sealed therein provided coaxially with a rotary shaft of the developer support, wherein the sealed viscous fluid damper includes an outer sleeve which includes an outer peripheral surface of the damper coaxially provided with the rotary shaft and being rotatable therewith;

a rotary inertial body having a smaller outside diameter than the inside diameter of the outer sleeve and coaxially mounted inside the outer sleeve so as to be freely rotatable; and a viscous fluid sealed between an inner surface of the outer sleeve and the rotary inertial body.

2. The image forming apparatus according to claim 1, wherein the viscous fluid is sealed between a peripheral inner surface of the outer sleeve and that of the rotary inertial body, and the outer sleeve is integrally fixed to the rotary shaft of either or both of the static latent image support and the developer support.

3. The image forming apparatus according to claim 2, wherein the viscous fluid is silica gel.

4. The image forming apparatus according to claim 1, wherein the viscous fluid is silica gel.

5. An image forming apparatus comprising:

a static latent image support;

a developer support which is supported in a developing unit and retains and conveys a developer so as to produce a visual image by developing the static latent image formed on the peripheral surface of the static latent image support with the developer from the developer support, a sealed viscous fluid damper having a viscous fluid sealed therein is provided coaxially with a rotary shaft of the developer support; and a flywheel attached to a rotary shaft of the static latent image support.

6. The image forming apparatus according to claim 5, wherein the sealed viscous fluid damper includes an outer sleeve which is an outer peripheral surface of the damper coaxially provided with the rotary shaft of the developer and being rotatable therewith;

a rotary inertial body having a smaller outside diameter than the inside diameter of the outer sleeve and coaxially mounted inside the outer sleeve so as to be freely rotatable; and a viscous fluid sealed between an inner surface of the outer sleeve and an outer peripheral surface of the rotary inertial body.

7. The image forming apparatus according to claim 6, wherein the viscous fluid is sealed between a peripheral surface of the outer sleeve and that of the rotary inertial body, and the outer sleeve is integrally fixed to the rotary shaft of the developer unit.

8. The image forming apparatus according to claim 7, wherein the viscous fluid is silica gel.

9. The image forming apparatus according to claim 6, wherein the viscous fluid is silica gel.

10. The image forming apparatus according to claim 5, wherein the viscous fluid is silica gel.

11. The image apparatus according to claim 5, further including a layer limiting member and, means for applying a bias voltage to the layer limiting member so as to control the electric field between the layer limiting member and the developer support.

12. The image forming apparatus of claim 11, wherein the developer support includes a magnet in its interior.

13. The image forming apparatus of claim 12, further including a supplying roller for electrifying a toner and supply it to the developer support.

* * * * *